US011523965B2

(12) United States Patent
MacIntosh

(10) Patent No.: US 11,523,965 B2
(45) Date of Patent: Dec. 13, 2022

(54) VIBRATIONAL MUSCLE MASSAGING SYSTEM

(71) Applicant: Colin MacIntosh, Santa Monica, CA (US)

(72) Inventor: Colin MacIntosh, Santa Monica, CA (US)

( * ) Notice: Subject to any disclaimer, the term of this patent is extended or adjusted under 35 U.S.C. 154(b) by 282 days.

(21) Appl. No.: 16/854,503

(22) Filed: Apr. 21, 2020

(65) Prior Publication Data

US 2021/0322260 A1 Oct. 21, 2021

(51) Int. Cl.
*A61H 23/02* (2006.01)
*A61H 15/00* (2006.01)
*A61H 23/00* (2006.01)

(52) U.S. Cl.
CPC ..... *A61H 23/02* (2013.01); *A61H 15/0092* (2013.01); *A61H 2023/002* (2013.01); *A61H 2201/0157* (2013.01); *A61H 2201/14* (2013.01)

(58) Field of Classification Search
CPC .. A61H 23/00; A61H 23/02; A61H 2201/169; A61H 2201/14; A61H 2201/0157; A61H 2201/501; A61H 2201/1685; A61H 2201/0107; A61H 2015/0014; H04M 1/04; B60R 2011/0075; A41D 2/205
See application file for complete search history.

(56) References Cited

U.S. PATENT DOCUMENTS 4,935,972 A * 6/1990 Brady ..... H05K 7/06 5/915
5,063,912 A * 11/1991 Hughes ..... A61M 21/00 446/295
5,344,437 A * 9/1994 Pistay ..... A61F 7/10 5/639
5,357,642 A * 10/1994 Clute ..... A47D 13/08 5/904
6,311,335 B1 * 11/2001 Uchida ..... A41D 27/205 2/250
6,929,612 B2 * 8/2005 Mangano ..... A61H 23/0263 601/72
D660,450 S 5/2012 Johnson
8,337,437 B2 12/2012 Hitzmann
8,556,837 B1 10/2013 Poirier
9,005,146 B2 4/2015 Phillips
9,668,933 B1 6/2017 Johnson
(Continued)

FOREIGN PATENT DOCUMENTS

WO WO2007112117 10/2007

*Primary Examiner* — Rachel T Sippel
*Assistant Examiner* — Kelsey E Baller

(57) ABSTRACT

A vibrational muscle massaging system includes a tubular member that is elongated and has a first end, a second end, and a perimeter surface extending between the first and second ends. The tubular member comprises a substantially solid member. The tubular member comprises a foamed elastomer and is resiliently compressible. The tubular member has a cylindrical shape and has a length greater than a diameter. The first end has a well extending therein. The well has a width that is greater than the height. The well is configured to receive a cellular phone to frictionally engage the cellular phone such that cellular phone extends outwardly away from first end. The tubular member vibrates when the cellular phone vibrates.

14 Claims, 3 Drawing Sheets

(56) References Cited

U.S. PATENT DOCUMENTS

| | | | | |
|---|---|---|---|---|
| 2005/0229316 | A1* | 10/2005 | Liao | A47G 9/1045 5/915 |
| 2009/0286571 | A1* | 11/2009 | Liu | A61H 23/0263 455/556.1 |
| 2015/0272815 | A1* | 10/2015 | Kitchens | A61H 23/0263 601/46 |
| 2016/0158096 | A1 | 6/2016 | Godfrey | |
| 2017/0020774 | A1* | 1/2017 | Rocklin | A61H 15/0085 |
| 2017/0071817 | A1* | 3/2017 | Sanchez | A61H 15/0092 |
| 2018/0228691 | A1 | 8/2018 | Marton | |
| 2018/0326176 | A1* | 11/2018 | Cloet | A47D 15/00 |
| 2018/0339216 | A1* | 11/2018 | Gencarelli | A61M 21/02 |
| 2020/0214928 | A1* | 7/2020 | Morris | A61H 1/00 |
| 2020/0375841 | A1* | 12/2020 | Owusu | A61H 15/02 |
| 2021/0100719 | A1* | 4/2021 | Delgado | A61H 15/00 |
| 2022/0015984 | A1* | 1/2022 | Solana | A61H 23/0254 |

* cited by examiner

VIBRATIONAL MUSCLE MASSAGING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to muscle massaging device and more particularly pertains to a new muscle massaging device for allowing a person to utilize the vibrational functions of their cellular phone for muscle massage purposes.

(2) Description of Related Art Including Information Disclosed Under 37 CFR 1.97 and 1.98

The prior art relates to muscle massaging devices and in particular foam rollers that are used to roll over a person's muscles by the person placing the roller under a particular body part to utilize the person's weight as the body port is rolled back and forth over the roller.

BRIEF SUMMARY OF THE INVENTION

An embodiment of the disclosure meets the needs presented above by generally comprising a tubular member that is elongated and has a first end, a second end, and a perimeter surface extending between the first and second ends. The tubular member comprises a substantially solid member. The tubular member comprises a foamed elastomer and is resiliently compressible. The tubular member has a cylindrical shape and has a length greater than a diameter. The first end has a well extending therein. The well has a width that is greater than the height. The well is configured to receive a cellular phone to frictionally engage the cellular phone such that cellular phone extends outwardly away from first end. The tubular member vibrates when the cellular phone vibrates.

In another embodiment the disclosure includes a system with a tubular member that is elongated and has a first end, a second end, and a perimeter surface extending between the first and second ends. The tubular member comprises a substantially solid member comprises of a foamed elastomer that is resiliently compressible. The tubular member has a cylindrical shape and has a length greater than a diameter. The first end has a well extending therein that has a width greater than a height. A cellular phone is removably positioned in the well such that the cellular phone is frictionally engaged by the tubular member. The cellular phone extends outwardly from the first end when the cellular phone is frictionally engaged to the tubular member. The cellular phone is configured to vibrate at a selected one of a plurality of frequencies and intensities. The tubular member vibrates when the cellular phone vibrates.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
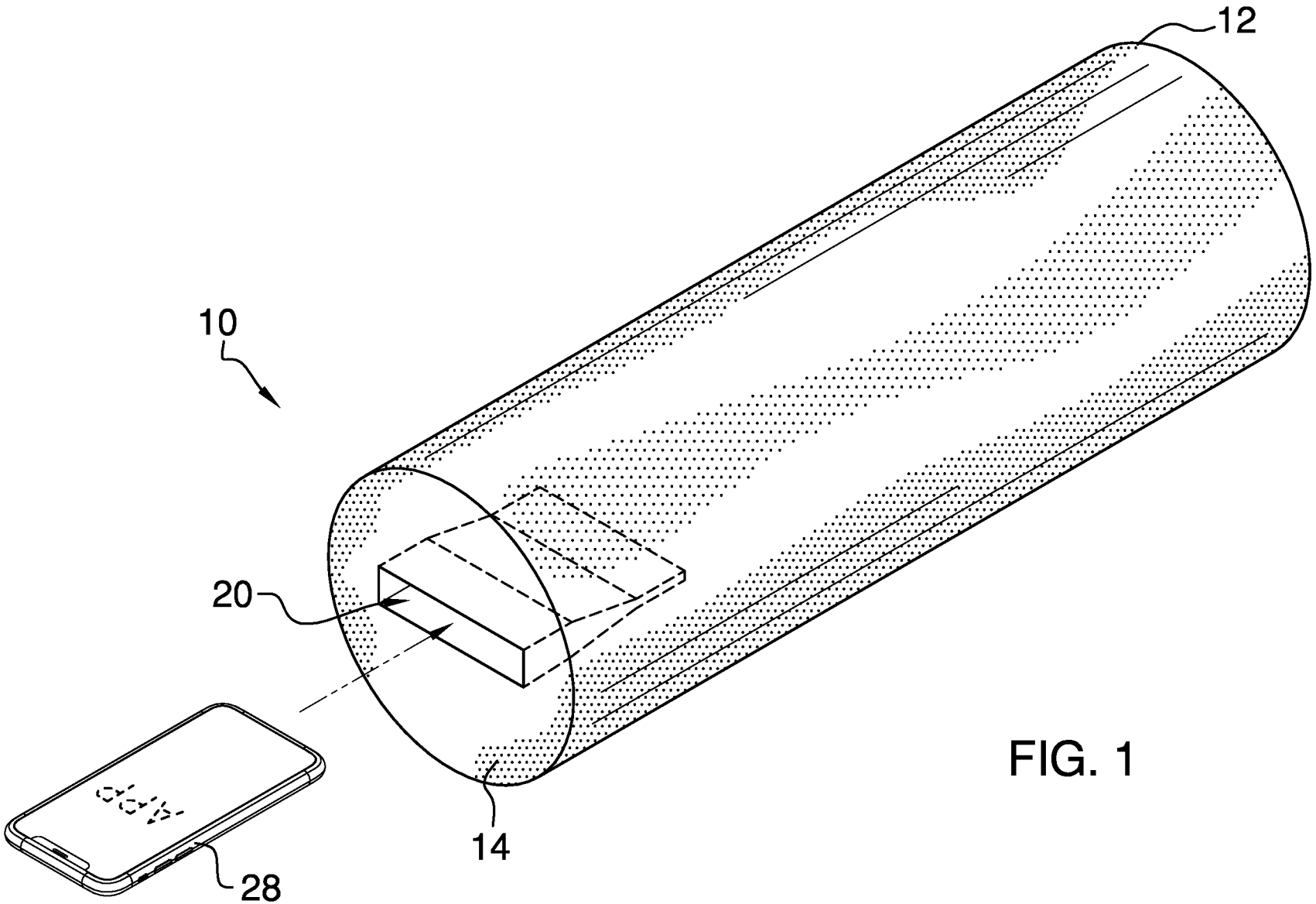
FIG. 1 is a side isometric view of a vibrational muscle massaging system according to an embodiment of the disclosure.
Figure 3:
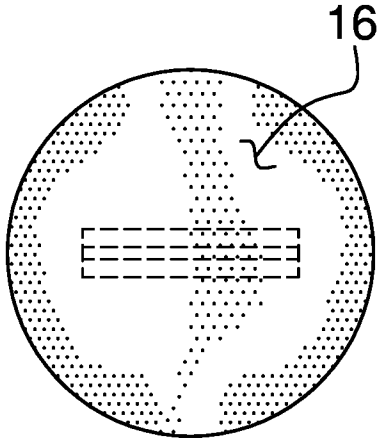
FIG. 3 is a rear view of an embodiment of the disclosure.
Figure 2:
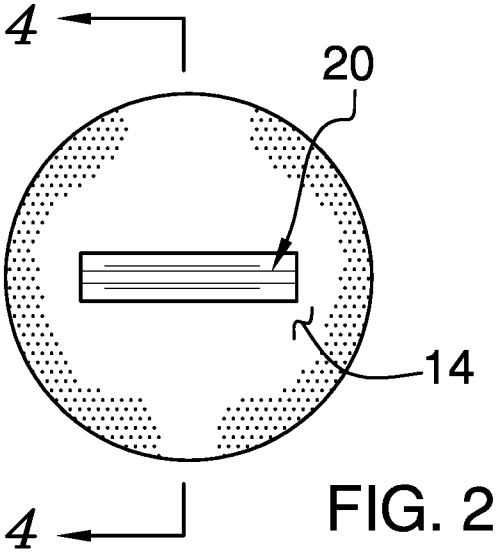
FIG. 2 is a side view of an embodiment of the disclosure.
Figure 4:
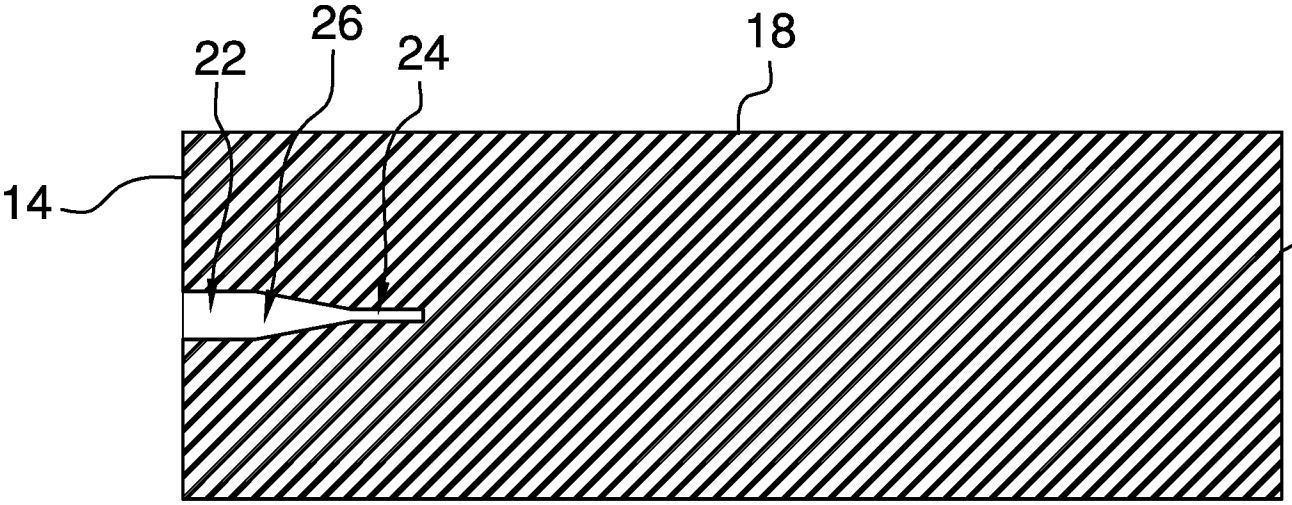
FIG. 4 is a cross-sectional view of an embodiment of the disclosure taken along line 4-4 of FIG. 2.
Figure 5:
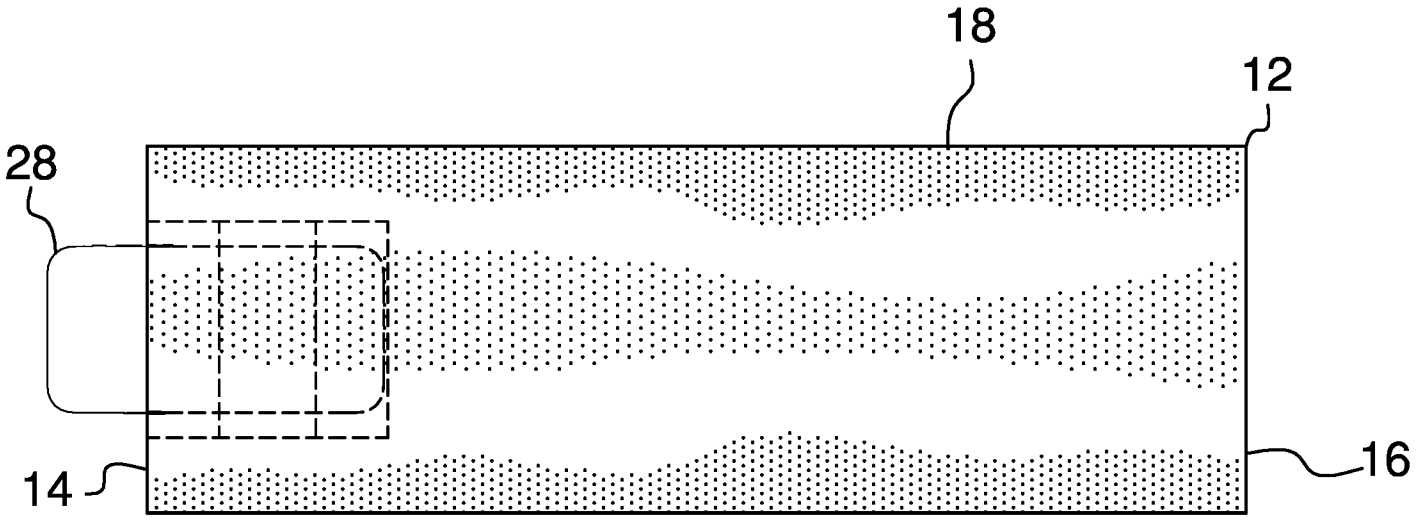
FIG. 5 is a top view of an embodiment of the disclosure.

With reference now to the drawings, and in particular to FIGS. 1 through 5 thereof, a new muscle massaging device embodying the principles and concepts of an embodiment of the disclosure and generally designated by the reference numeral 10 will be described.

As best illustrated in FIGS. 1 through 5, the vibrational muscle massaging system 10 generally comprises a tubular member 12 that is elongated and has a first end 14, a second end 16, and a perimeter surface 18 extending between the first 14 and second 16 ends. The tubular member 12 comprises a substantially solid member. The tubular member 12 is a generally conventional muscle massage roller and is comprised of a foamed elastomer material that is resiliently compressible. The resiliency can be selectively chosen depending on the needs of the user. The tubular member 12 has a cylindrical shape and has a length greater than its diameter. While the tubular member 12 may have any size, the diameter will typically be between 5.0 inches and 8.0 inches and the length will most often be from 12.0 inches to 36.0 inches.

The first end 14 has a well 20 extending therein. The well 20 has a width, height and depth wherein the width is greater than the height. The well 20 has a first section 22, a second section 24, and middle section 26 positioned between the first 14 and second 16 sections. The first section 22 is positioned adjacent to the first end 14 and the second section 24 is positioned between the middle section 26 and the second end 16. The first section 22 has a greater height than the second section 24 so that the second section 24 can frictionally engage a cellular phone 28. A height of the middle section 26 decreases from the first section 22 to the second section 24.

More particularly, the well 20 has a width between 80.0 mm and 100.0 mm and a total depth of between 80.0 mm and 150.0 mm. The first section 22 has a depth between 20.0 mm and 40.0 mm, the middle section 26 has a depth between 30.0 mm and 50.0 mm, and the second section 24 has a depth between 20.0 mm and 40.0 mm. A typical cellular phone 28 has a length greater than 100.0 mm such that the cellular phone 28 will extend outwardly of the well 20 when the cellular phone 28 is fully extended into the well 20.

The height of the first section 22 is between 15.0 mm and 25.0 mm and a height of the second section 24 is between 4.0 mm and 8.0 mm. In one embodiment, a height of the second section 24 is 5.0 mm while a height of the first section is 20.0 mm.

The cellular phone 28 is provided which is generally conventional and on which is an application to control the vibration of the cellular phone 28. More particularly, the application allows a user to select the frequency and intensity of vibrating means of the cellular phone 28. As all cellular phones 28 include vibrating means, and such vibration means are programmable, the application may be written utilizing known methods. In this manner, the user selects desired vibration of the tubular member 12 that will applied to the user's muscles.

In use, the cellular phone 28 is extended into the well 20 to frictionally engage the tubular member 12. This frictional engagement mechanically joins the cellular phone 28 and tubular member 12 such that vibration of cellular phone 28 is transferred to the tubular member 12. The user will turn on the application and select the type of vibration desired. While the cellular phone 28 and tubular member 12 vibrate, the tubular member 12 is used to massage the muscles of the user. The cellular phone 28 extends between 10.0 mm and 50.0 mm outwardly of the first end 14 to facilitate gripping the cellular phone 28 to remove the cellular phone 28 from the tubular member 12 at the end of the massage session. The application may include a timer such that the vibration ends after a predetermined amount of time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A muscle massage roller assembly configured to receive a cellular phone, the assembly comprising:

a tubular member being elongated and having a first end, a second end, and a perimeter surface extending between the first and second ends, the tubular member comprising a solid member, the tubular member comprising a foamed elastomer and being resiliently compressible, the tubular member having a cylindrical shape and having a length greater than a diameter; and the first end having a well extending therein, the well having a width, height and depth, the width being greater than the height, the well being configured to receive the cellular phone to frictionally engage the cellular phone such that cellular phone extends outwardly away from the first end, wherein the well has a first section, a second section, and a middle section positioned between the first and second sections, the first section being positioned adjacent to the first end, the second section being positioned between the middle section and the second end, the first section having a greater height than the second section, the second section being configured to frictionally engage the cellular phone, a height of the middle section decreasing from the first section to the second section wherein the first section is configured for the tubular member to be spaced from the cellular phone within the first section when the second section frictionally engages the cellular phone;

wherein the tubular member vibrates when the cellular phone vibrates.

2. The muscle massage roller assembly according to claim 1, wherein the tubular member has a diameter between 5.0 inches and 8.0 inches, the tubular member having a length from 12.0 inches to 36.0 inches.

3. The muscle massage roller assembly according to claim 1, wherein the well has a width being between 80.0 mm and 100.0 mm.

4. The muscle massage roller assembly according to claim 3, wherein the well has a total depth of between 80.0 mm and 150.0 mm.

5. The muscle massage roller assembly according to claim 4, wherein the first section has a depth between 20.0 mm and 40.0 mm, the middle section has a depth between 30.0 mm and 50.0 mm, and the second section has a depth between 20.0 mm and 40.0 mm.

6. The muscle massage roller assembly according to claim 5, wherein the height of the first section is between 15.0 mm and 25.0 mm, and the height of the second section is between 4.0 mm and 8.0 mm.

7. The muscle massage roller assembly according to claim 1, wherein the first section has a depth between 20.0 mm and 40.0 mm, the middle section has a depth between 30.0 mm and 50.0 mm, and the second section has a depth between 20.0 mm and 40.0 mm.

8. The muscle massage roller assembly according to claim 1, wherein the height of the first section is between 15.0 mm and 25.0 mm, and the height of the second section is between 4.0 mm and 8.0 mm.

9. A muscle massaging system comprising:

a tubular member being elongated and having a first end, a second end, and a perimeter surface extending between the first and second ends, the tubular member comprising a solid member, the tubular member comprising a foamed elastomer and being resiliently compressible, the tubular member having a cylindrical shape and having a length greater than a diameter; and the first end having a well extending therein, the well having a width, height and depth, the width being greater than the height, wherein the well has a first section, a second section, and a middle section positioned between the first and second sections, the first section being positioned adjacent to the first end, the second section being positioned between the middle section and the second end, the first section having a greater height than the second section;

a cellular phone being removably positioned in the well such that the cellular phone is frictionally engaged by the tubular member, the cellular phone extending outwardly from the first end when the cellular phone is frictionally engaged to the tubular member, the second section being configured to frictionally engage the cellular phone, a height of the middle section decreasing from the first section to the second section wherein the the tubular member is spaced from the cellular phone within the first section when the second section frictionally engages the cellular phone;

the cellular phone being configured to vibrate at a plurality of frequencies and intensities, the tubular member vibrating when the cellular phone vibrates.

10. The muscle massage roller assembly according to claim 9, wherein the tubular member has a diameter between 5.0 inches and 8.0 inches, the tubular member having a length from 12.0 inches to 36.0 inches.

11. The muscle massage roller assembly according to claim 10, wherein the well has a width being between 80.0 mm and 100.0 mm.

12. The muscle massage roller assembly according to claim 11, wherein the well has a total depth of between 80.0 mm and 150.0 mm.

13. The muscle massage roller assembly according to claim 12, wherein the first section has a depth between 20.0 mm and 40.0 mm, the middle section has a depth between 30.0 mm and 50.0 mm, and the second section has a depth between 20.0 mm and 40.0 mm.

14. The muscle massage roller assembly according to claim 13, wherein the height of the first section is between 15.0 mm and 25.0 mm, and the height of the second section is between 4.0 mm and 8.0 mm.

* * * * *